US007080772B2

(12) United States Patent
Lebras

(10) Patent No.: US 7,080,772 B2
(45) Date of Patent: Jul. 25, 2006

(54) TRAY CONTAINER AND BLANK

(75) Inventor: Philippe Lebras, Chateauroux (FR)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 127 days.

(21) Appl. No.: 10/440,687

(22) Filed: May 19, 2003

(65) Prior Publication Data

US 2004/0011860 A1 Jan. 22, 2004

Related U.S. Application Data

(63) Continuation of application No. PCT/US01/43575, filed on Nov. 17, 2001.

(30) Foreign Application Priority Data

Nov. 17, 2000 (GB) ..... 0028086

(51) Int. Cl.
*B65D 5/12* (2006.01)

(52) U.S. Cl. ..... 229/122.27; 229/167; 229/170; 229/174; 229/122.34

(58) Field of Classification Search ..... 229/243, 229/244, 163, 162, 292, 298, 155, 156, 157, 229/122.29, 149, 150, 103, 122.27, 167, 229/166, 170, 185.1, 120.11, 120.21, 122.34, 229/173, 174, 175
See application file for complete search history.

(56) References Cited

U.S. PATENT DOCUMENTS

| | | | | |
|---|---|---|---|---|
| 877,757 | A * | 1/1908 | Comings | 229/172 |
| 1,566,505 | A * | 12/1925 | Pinkerton | 229/151 |
| 1,941,084 | A | 12/1933 | Gross | |
| 2,105,270 | A | 1/1938 | Scheffey | |
| 2,148,048 | A * | 2/1939 | Gray | 229/120.01 |
| 2,472,516 | A | 6/1949 | Buttery | |
| 2,605,954 | A | 8/1952 | Williamson | |
| 2,670,125 | A * | 2/1954 | Frankenstein | 206/784 |
| 2,765,113 | A * | 10/1956 | Williamson | 229/168 |
| 2,925,211 | A | 2/1960 | Frankenstein | |
| 2,983,428 | A * | 5/1961 | Bess | 229/159 |
| 3,122,299 | A | 2/1964 | Haas | |
| 3,156,402 | A | 11/1964 | Dupuls | |
| 3,347,445 | A * | 10/1967 | Wood | 206/45.3 |
| 3,446,413 | A * | 5/1969 | Sherrill et al. | 229/122.27 |
| 4,341,339 | A * | 7/1982 | Zore | 229/148 |
| 4,372,476 | A * | 2/1983 | Harned et al. | 229/120.17 |
| 4,796,801 | A | 1/1989 | Goetz | |
| 5,078,268 | A * | 1/1992 | Olson et al. | 206/387.1 |

FOREIGN PATENT DOCUMENTS

| | | |
|---|---|---|
| DE | 93009925 | 3/1993 |
| EP | 0540482 A1 | 10/1992 |
| FR | 1418994 | 10/1964 |
| GB | 580826 | 9/1946 |
| GB | 703842 | 2/1954 |

(Continued)

*Primary Examiner*—Tri M. Mai
(74) *Attorney, Agent, or Firm*—Tsugihiko Suzuki

(57) ABSTRACT

A tray and a blank for forming a tray for holding foodstuff or the like which tray is formed from paperboard or like foldable sheet material and can be erected from a flat collapsed condition into a position of use. The tray comprises a plurality of panels for forming a base, opposed side and end walls wherein the panels forming the tray are a composite structure comprising inner and outer panels forming the base, side and end walls. The insert is retained in the tray by means of a securing tab formed from the tray and engaged by an upper edge of the insert.

19 Claims, 9 Drawing Sheets

FOREIGN PATENT DOCUMENTS

| | | |
|---|---|---|
| GB | 719292 | 12/1954 |
| GB | 1372054 | 10/1974 |
| GB | 1495075 | 12/1977 |
| WO | 9309032 A1 | 5/1993 |
| WO | 9315962 A1 | 8/1993 |
| WO | 0015520 A1 | 3/2000 |

* cited by examiner

TRAY CONTAINER AND BLANK

This is a continuation of international application No. PCT/US01/43575, filed Nov. 17, 2001, which is hereby incorporated by reference.

BACKGROUND OF THE INVENTION

The present invention relates to a carton (or tray) for accommodating foodstuff, for example fish or meat, and more particularly to a carton formed from one or more blanks of paperboard of other suitable foldable sheet material.

Tray structures for meat are commonly formed from plastics material, for example polystyrene.

There can be excess food liquid, for example blood or water from foodstuff which is undesirable. One solution is illustrated in U.S. Pat. No. 3,156,402 which shows a food products support tray including two layers in which the liquid is stored. The liquid passes through openings and is held between the layers. It is apparent that handling of the tray will push liquid back through the openings. Further, if the tray is stored in an upright position, the liquid will collect along the edges and at the corners.

It is known from WO 93/15962 to provide a fluid tight packaging tray formed from cardboard comprising a single base panel surrounded by side and end wall structures and connected by an enclosure arrangement to maintain a foodtight seal and to prevent liquid from rising by capillarity.

SUMMARY OF THE INVENTION

The present invention and its preferred embodiments seek to overcome or at least mitigate the problems of the prior art.

One aspect of the invention provides a tray for holding foodstuff or the like which tray is formed from paperboard or like foldable sheet material and can be erected from a flat collapsed condition into a position of use. The tray comprising a plurality of panels for forming a base, opposed side and end walls wherein the panels forming the tray are a composite structure comprising inner and outer panels forming the base, side and end walls. Preferably, the inner panels forming the base, side and end walls are provided by an insert.

According to an optional feature of this aspect of the invention, the insert is retained in the tray by means of a securing tab formed from one of the insert or the tray and engaged with the other one of the insert or the tray. The securing tab may be struck from the outer side panel and is adapted to protrude inwardly thereby to abut an upper edge of the inner side wall panel of the insert.

According to another optional feature of this aspect of the invention, there further comprises a beam support structure formed along one side of the tray from the inner side panel foldably connected along a first fold line to the outer base panel and the outer side panel foldably connected along a second fold line to the outer base panel, wherein the first and second fold lines are offset such that the inner side panel extends upwardly to abut the outer end panel thereby to define the beam.

A spacer panel may hingedly interconnect the inner and outer end panels to form the beam. The securing tab may extend from the spacer panel.

Preferably, the insert may be provided with an end panel, which end panel extends outwardly beyond the base panel to be sandwiched between the end of the side wall structure and the end wall of the tray to restrict movement of the insert within the tray.

According to a further optional feature of this aspect of the invention, there is a deformable portion hinged to the adjacent side and end panels between the base panel and the securing means, said deformable portion deformed when the tray is erected to provide a ply of material spanning the side and end panels to inhibit egress of fluid from the base panel at each said corner of the tray.

The deformable portion may be hingedly connected to the adjacent side panel by a fold line in an obtuse angular relationship with the fold line connecting the end panel and base panel.

According to an optional feature of this aspect of the invention, the securing means comprises a flap hingedly connected to one of said side and end panels and foldable to be superposed with the other said side and end panels to be secured therewith, which flap is severed from the deformable portion.

The deformable portion may be provided by a gusset panel.

According to another optional feature of this aspect of the invention, the inner and outer walls forming the base and the side and end walls define one or more skinned zones providing one or more voids wherein means are provided to give fluid communication between the internal surface of the base and said void so that fluid present in the tray can drain into the voids in the base and in the side and end walls.

Preferably, the fluid communication means comprises a plurality of perforations distributed along at least one edge of the inner base wall.

Optionally, the voids include absorbing means to absorb said liquid. The absorbing means may be provided by a layer of liquid absorbing material placed in at least one of the voids.

Preferably, the internal surface of the base is impermeable.

A second aspect of the invention provides a unitary blank for forming a tray comprising a blank for forming a tray for holding foodstuff or the like which tray is formed from paperboard or like foldable sheet material comprising a plurality of panels for forming an outer base, opposed side and end walls and an insert comprising a plurality of panel forming the inner base, side and end walls.

A third aspect of the invention provides a blank for forming a tray for holding foodstuff or the like which tray is formed from paperboard or like foldable sheet material comprising a plurality of panels for forming an outer base, opposed side and end walls and a blank for forming an insert comprising a plurality of panel forming the inner base, side and end walls.

The securing tab is struck from the outer side panel and is adapted to protrude inwardly thereby to abut an upper edge of the inner side wall panel of the insert.

There may further comprise a beam support structure formed along one side of the tray from the inner side panel foldably connected along a first fold line to the outer base panel and the outer side panel foldably connected along a second fold line to the outer base panel, wherein the first and second fold lines are offset such that the inner side panel extends upwardly to abut the outer end panel thereby to define the beam in a set up tray.

According to an optional feature of the second or third aspects of the invention, there further comprises a spacer panel hingedly interconnecting the inner and outer end panels to form the beam in a set up condition.

According to an optional feature of the second or third aspects of the invention, there further comprises a deformable portion hinged to the adjacent side and end panels between the base panel and the securing means, said deformable portion deformed when the tray is erected to provide a ply of material spanning the side and end panels to inhibit egress of fluid from the base panel at each said corner of the tray.

Preferably, the deformable portion is hingedly connected to the adjacent side panel by a fold line in an obtuse angular relationship with the fold line connecting the end panel and base panel.

According to an optional feature of the second or third aspects of the invention, the securing means comprises a flap hingedly connected to one of said side and end panels and foldable to be superposed with the other said side and end panels to be secured therewith, which flap is severed from the deformable portion.

According to a further optional feature of the second or third aspects of the invention, said deformable portion is provided by a gusset panel.

There may further comprise a plurality of perforations distributed along at least one edge of the base.

A fourth aspect of the invention provides a method of forming a tray from a blank which method comprises the steps:

(i) forming a two ply base, end and side wall structures;

(ii) folding the side walls out of alignment with the base such that the inner end panels are automatically erected in response to folding the opposed side walls towards each other; and (iii) folding the outer end panels to abut a portion of the inner end walls to be secured to the side walls thereby to complete construction of the tray.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1A:
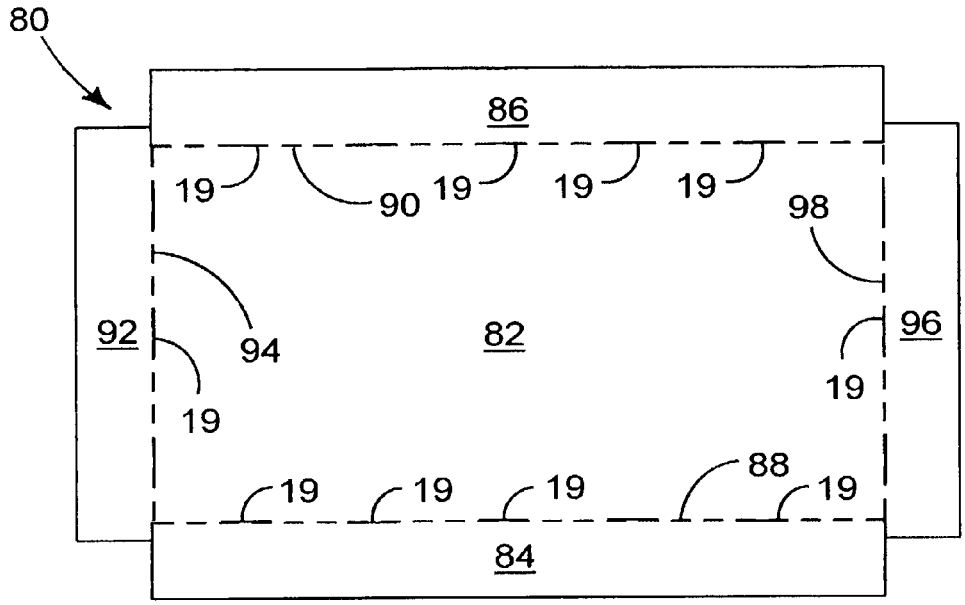
FIG. 1A is a plan view of the blank for forming an insert for the tray shown in FIG. 1.
Figure 1:
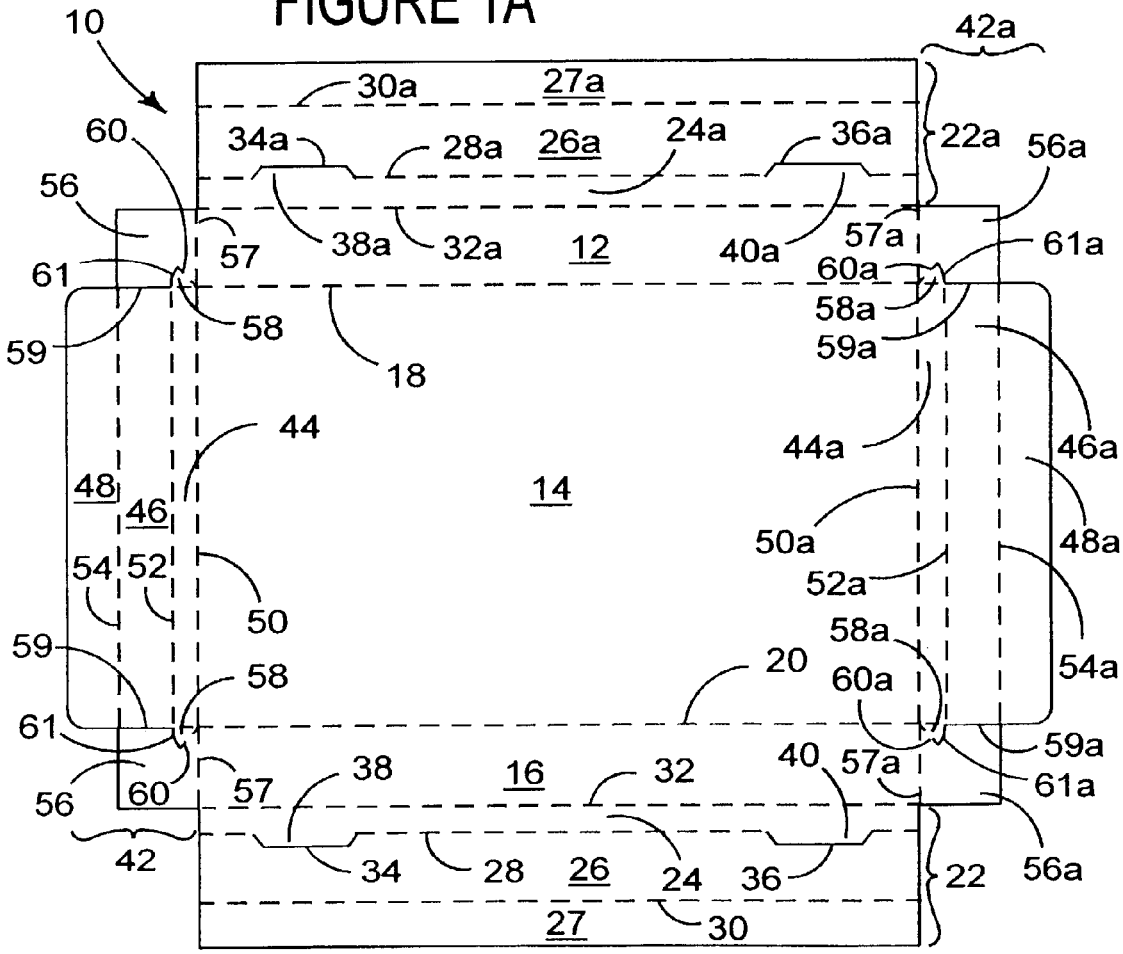
FIG. 1 is a plan view of a blank for forming an outer tray according to a preferred embodiment of the invention.

Referring first to FIG. 1 there is shown a blank 10 for forming a collapsible tray or carton made from one or more blanks of paperboard or similar foldable sheet material. The blank 10 comprises a plurality of panels for forming an outer tray. A separate insert blank 80 is provided which is described in more detail below.

In this embodiment the outer tray blank 10 comprises a first outer side wall panel 12, base panel 14, and second outer side wall panel 16 hingedly connected together in series along foldlines 18, 20 respectively. There further comprises an inner side wall structure 22, 22*a* hingedly connected to side wall panels 16 and 12 respectively along fold lines 32 and 32*a*.

Turning to the construction of inner side wall structure 22, there comprises a securing flap 27 and an inner side wall panel 26 hingedly connected together along fold line 30. In some embodiments the inner side wall panel 26 is connected to outer side wall panel, although in the illustrated embodiment, there may further comprise spacer panel 24 hingedly interconnecting outer side wall panel 16 to inner side wall panel 26 along fold lines 32 and 28 respectively.

There further comprises one or more tabs 38, 40 that extend from the inner side wall panel 26 or, in this embodiment, spacer panel 24 and into inner side wall panel 26. The free edges of tabs 38, 40 are defined by cut lines 34 and 36 respectively, the opposing ends of which cut lines intersect with interrupted fold line 28.

The opposing inner wall structure 22*a* is identical in construction to inner wall panel 22 and like parts have been designated by the same reference numeral with the addition of the letter "a": therefore they are not described in any greater detail.

End structures 42, 42*a* are hingedly connected to the opposing ends of base panel 14 along fold lines 50 and 50*a* respectively. The construction of each end structure 42, 42*a* is identical and like references have been used. Therefore, describing the end structure 42 in more detail, there comprises an end panel 46 hingedly connected to base panel 14. In this embodiment, there may comprise an intermediate panel 44 hingedly interconnecting end panel 46 to base panel 16. Intermediate panel 44 is connected to end panel 46 along fold line 52. The intermediate panel 44 is used when a fluid retaining structure is employed, described in more detail below.

There may further comprise an end support flap 48 hingedly interconnected to end wall panel 46 along fold line 54 to support stretch film placed over the tray.

Suitable securing means for connecting the end and the side wall panels is provided. In this embodiment there comprises a pair of oppositely disposed securing flaps 56, extending from corresponding ends of the side wall panels 16 and 12 and are connected thereto along a co-linear extension of fold line 50, designated by reference numeral 57. The securing flaps 56 are adjacent end wall panel 46 and are separated in part from end wall panel 46 by cut lines 59. A second pair of identical securing flaps 56*a* are hingedly connected to the opposite ends of side wall panels 12 and 16 along fold line 57*a*.

In this embodiment, there comprises one or more fluid retaining structures. It will be seen from FIG. 1 that the fluid retention structure comprises a tab 58 formed from end flap 56 and hingedly connected thereto along fold line 60. In use, the tab 58 forms a deformable portion that prevents egress of fluid. Fold line 60 extends outwardly from the intersection of the fold lines 18, 50 connecting the side wall and end wall to the base panel 14. A cut line 61 extends from the cut line 59 to the edge of fold line 60.

Preferably, tab 58 is hingedly connected to end wall panel 46 along an extension of fold line 18 or 20 respectively.

There usually comprises a fluid retaining structure positioned in each of the corners of the side and end walls of the tray, although these are not shown in FIGS. 2 to 11.

As mentioned above, there further comprises a separate insert 80 to be used with tray blank 10, which insert comprising a base panel 82, opposed side wall panels 84, 86 hingedly connected to base panel 82 along fold lines 88 and 90 and opposed end wall panels 92 and 96 hingedly connected to the base panel along fold lines 94 and 98 respectively. Preferably, the end wall panels 92, 96 are wider than base panel 82 such that the opposite ends of the end wall panels project outwardly beyond the side edges of the base panel.

Figure 12:
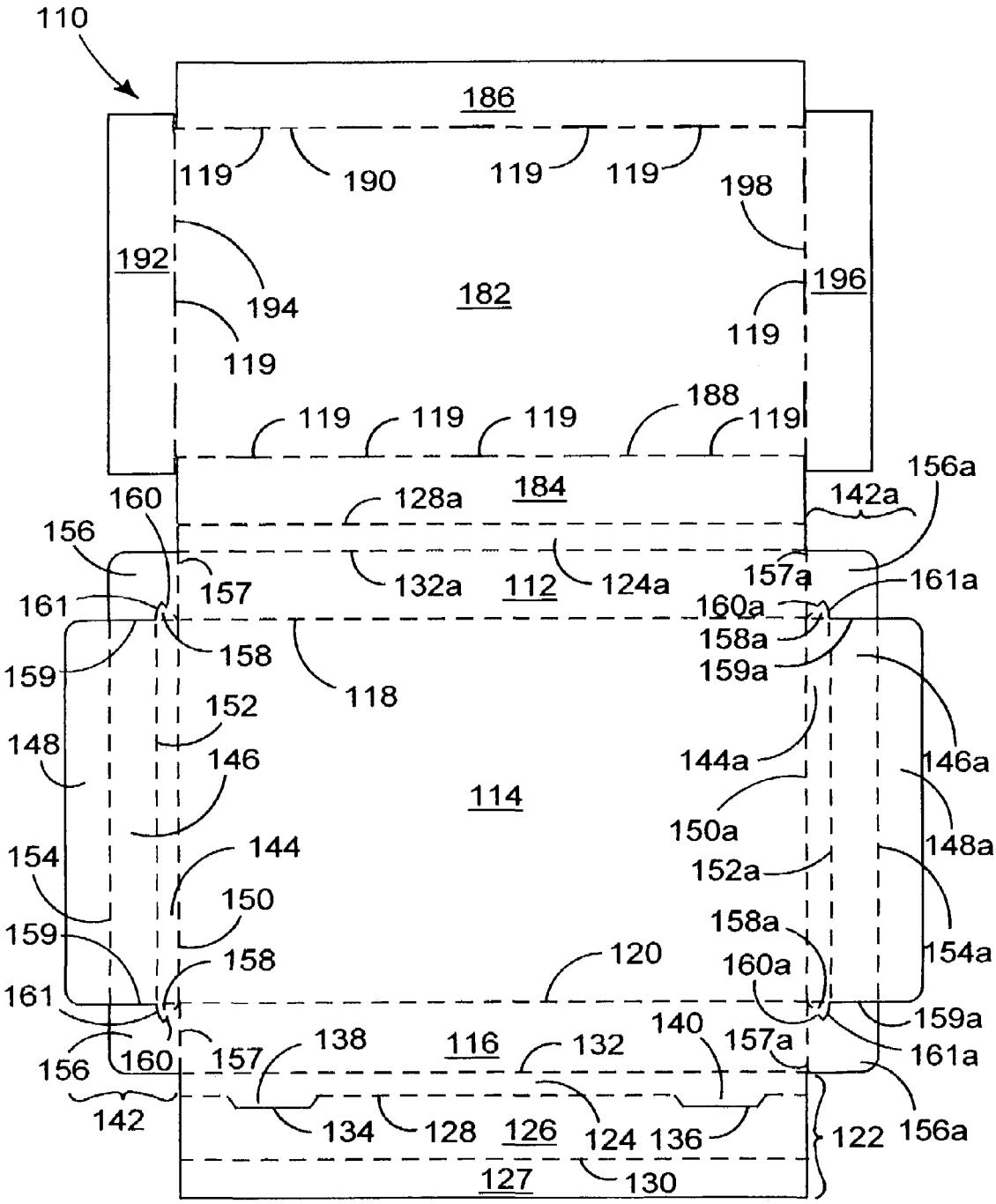
FIG. 12 is a plan view of a unitary blank for forming a tray according to a second embodiment.
Figure 13:
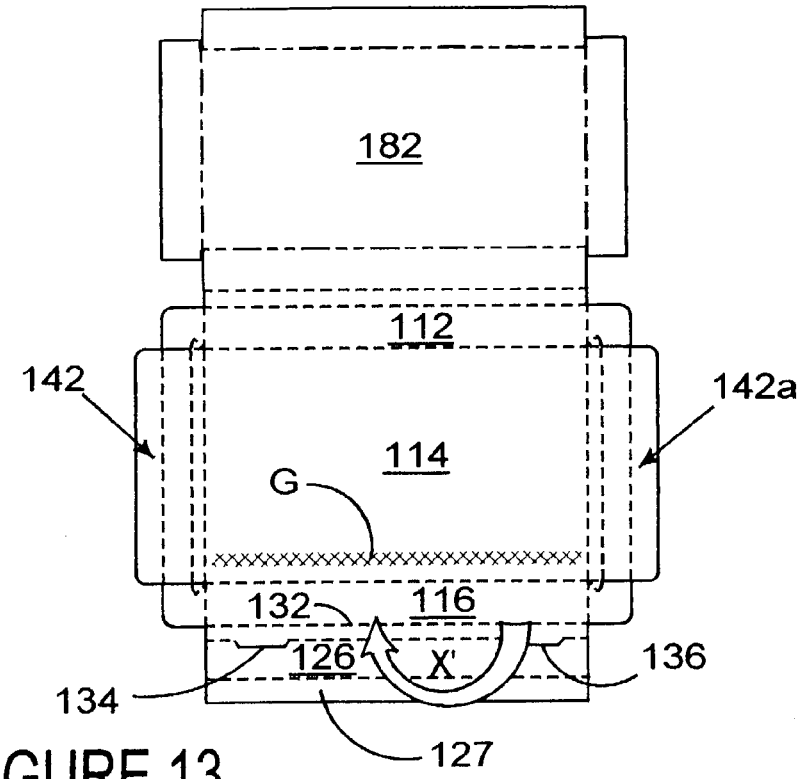
FIGS. 13 and 14 illustrate the construction of the tray from the blank of FIG. 12.

Although there are shown separate blanks for the tray and insert, it is envisaged that a unitary blank for both parts could be used without departing from the scope of invention, for example in the second embodiment shown in FIG. 12, the blank 110 comprises panels for forming the outer tray T and the insert I is connected to the outer tray. The second embodiment is similar to the first embodiment with like parts being designated by the same reference numerals with the addition of "1". Only the differences will now be described in any greater detail.

The side wall 184 of the insert is to connected to spacer panel 124*a* along fold line 128*a*; thus in this embodiment, the insert side wall panel 184 also functions as the inner side wall of the outer tray. The insert I further comprises opposed side wall panel 186, base panel 182 and opposed end wall panels 196 which are preferably aligned with the end wall structures of the outer tray. The securing tabs 138, 140 are struck from one side wall only, as the insert is joined to the tray. The outer tray structure T is in other respects identical to the first embodiment, referred to above.

The construction of the tray is described by reference to FIGS. 2 to 11 and 13 to 16. It is envisaged that the construction of a flat collapsed carton and final construction and loading of the tray of the present invention can be formed by a series of sequential folding and gluing operations which can be performed in one or more straight line machines, so that the tray is not required to be rotated or inverted to complete its construction. The folding process is not limited to that described below and can be altered according to particular manufacturing requirements.

Figure 2:
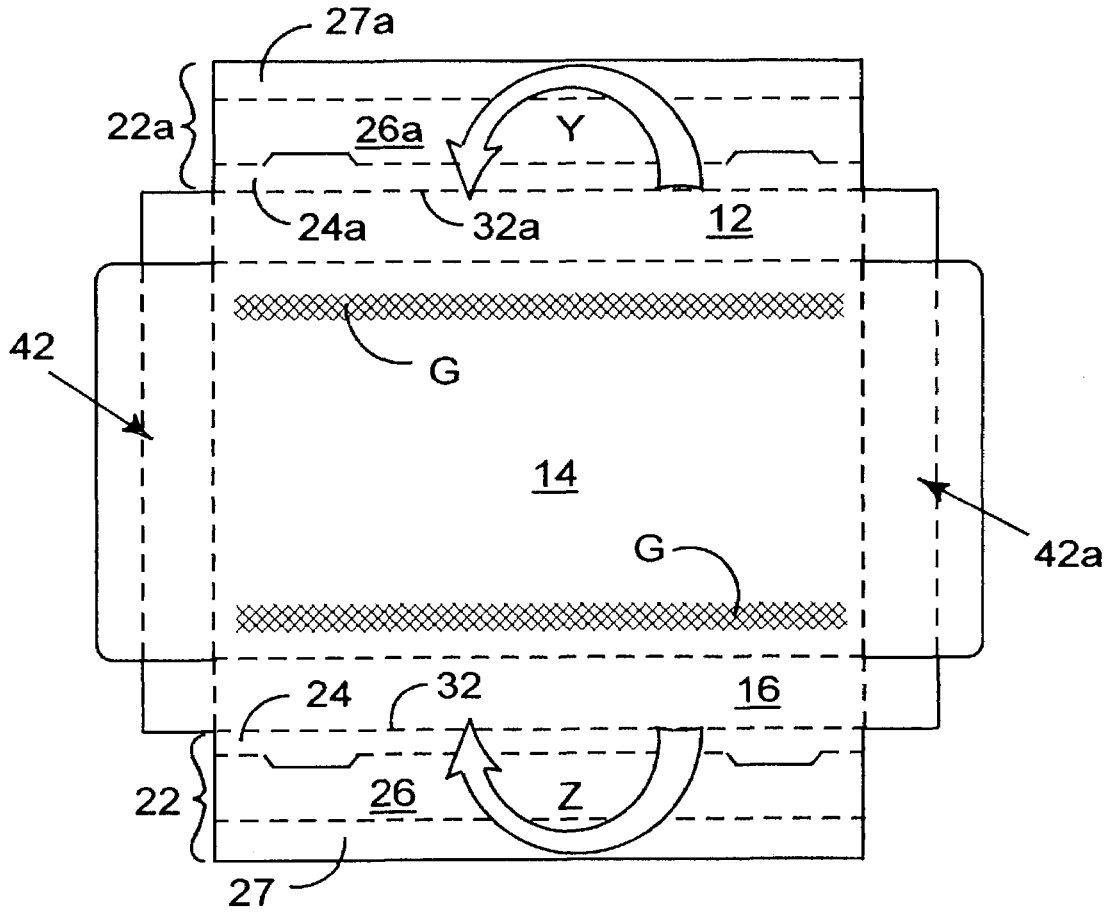
FIGS. 2, 3, 4 and 5 illustrate formation of the tray from the blank of FIGS. 1 and 2.
Figure 3:
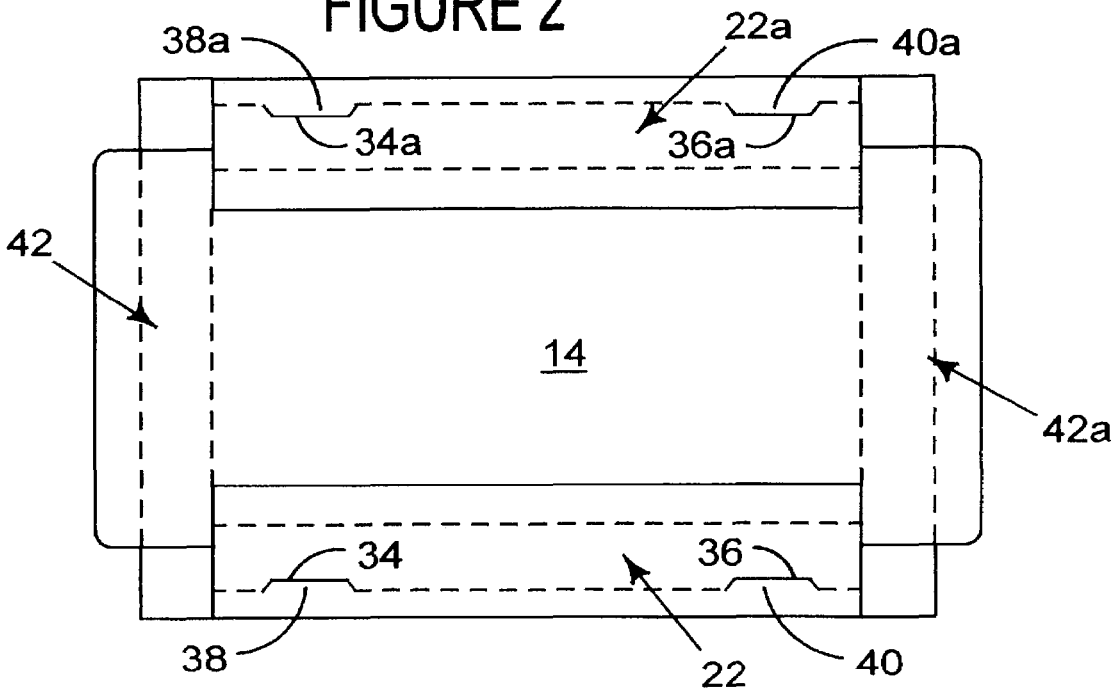

In the first embodiment, the side walls are constructed, as illustrated in FIGS. 2 and 3 whereby the inner side wall structures 22 and 22*a* of the outer tray are folded inwardly along fold lines 32 and 32*a* respectively in directions Y and Z and are secured to the base panel 14. In the embodiment illustrated, securing panels 28 and 28*a* are secured to base wall panel 14 by glue or other suitable securing means known in the art. Thus, the tray T is in a flat collapsed form as shown in FIG. 3 to be supplied to the user so it can be erected.

In order to erect the tray T (FIG. 11), the outer side wall panels 12 and 16 are folded inwardly which causes the inner and outer side wall panels to be separated and spaced therefrom by the spacer panels 24 and 24*a*, and because fold lines 20 and 30 are spaced. This action causes the tabs 38, 40; 38*a*, 40*a* to become separated from the respective inner side wall panels 26 and 26*a* thereby to protrude inwardly with respect to the side walls, as shown in FIG. 4.

Figure 4:
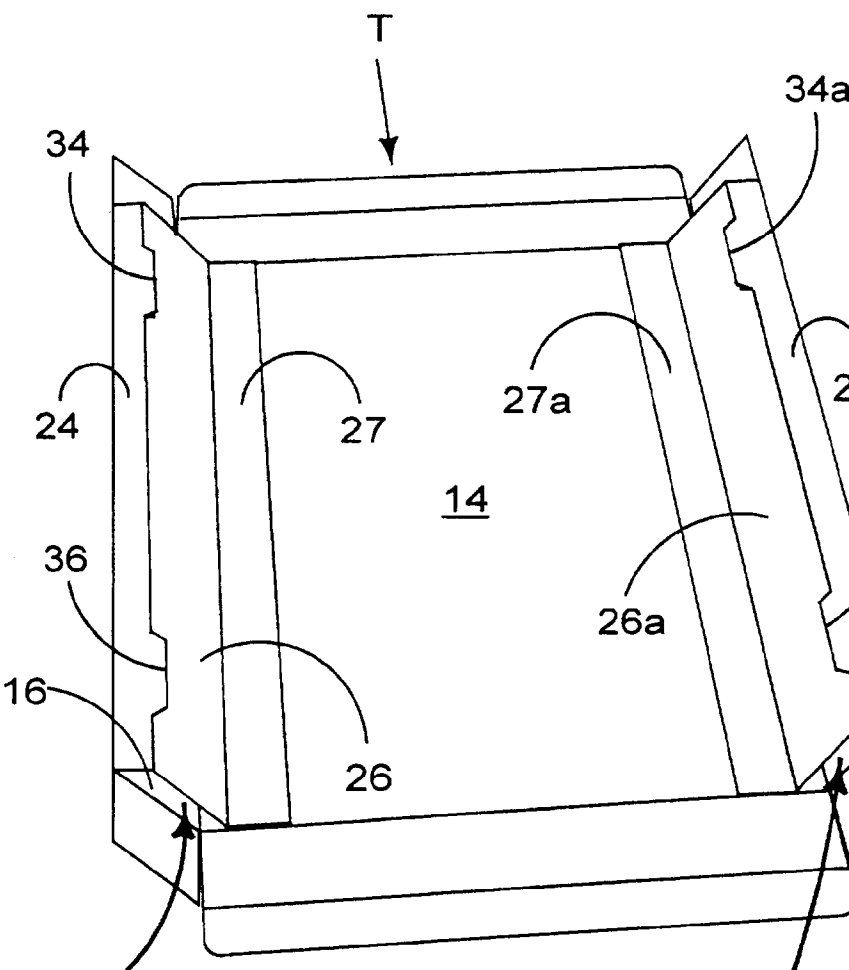
Figure 6:
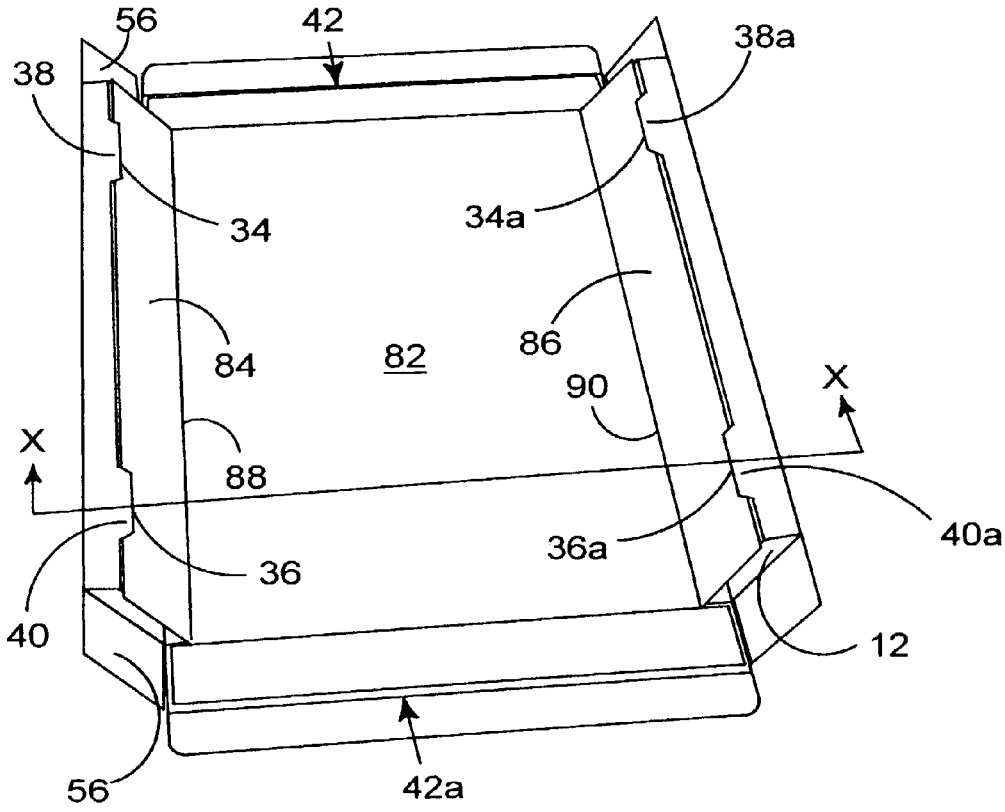
FIG. 6 is a perspective view of the tray and insert shown during folding of the side walls.

Preferably, support structure is provided at each side, defined by inner and outer side wall panels 26, 26*a*; 12, 16, the spacer panel and part of outer base panel 14 of the outer tray which forms a beam B (FIGS. 4 and 6). It is envisaged that the support structure could be incorporated into the invention with or without the presence of fluid retaining structures.

Figure 5:
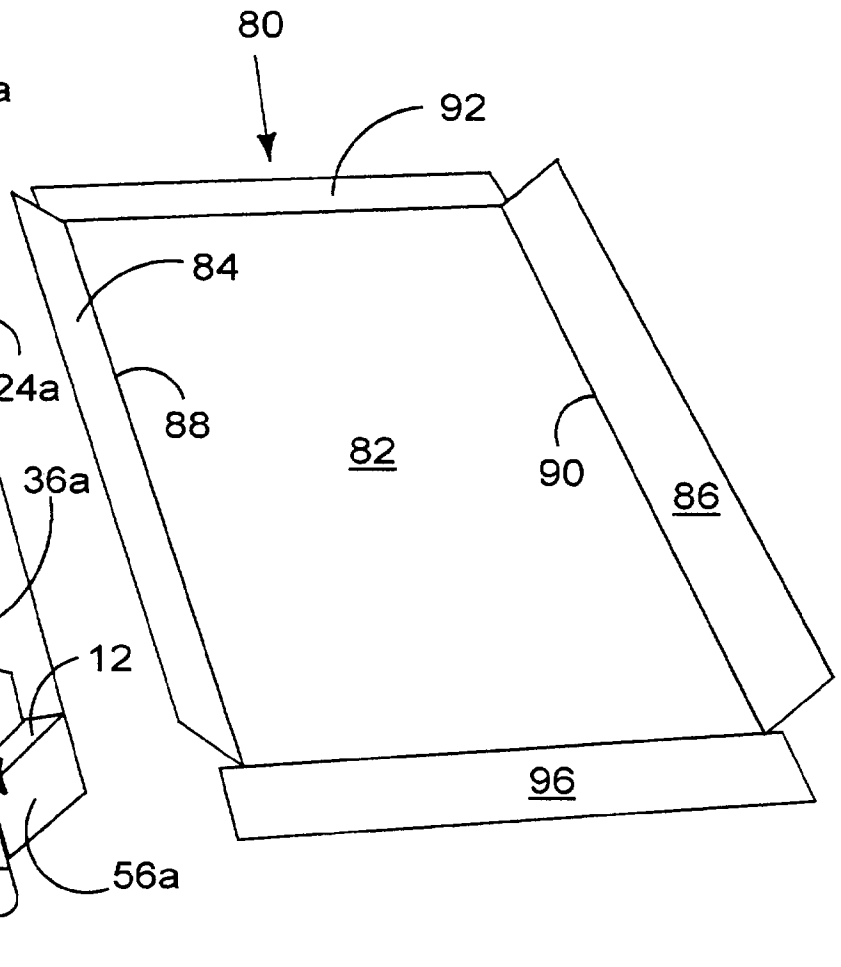

Insert tray 80 is placed on base panel 14 by relative vertical movement between the insert and tray in a packaging machine, as is well known. Preferably, side wall panels 84 and 86 are folded inwardly along fold lines 88 and 90, as shown in FIG. 5. In one class of embodiments, base panel 82 is secured to base panel 14 by glue or other suitable means known in the art, although it is advantageous not to secure the aforementioned panels together so as to provide a void V1 illustrated in FIG. 7.

Figure 7:
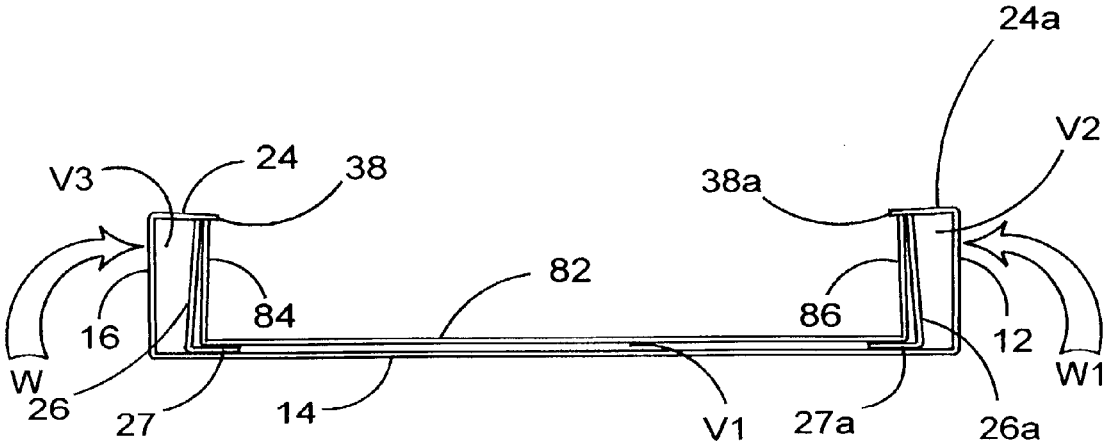
FIG. 7 is a cross-sectional view X—X of the carton formed from a blank shown in FIG. 6.

The insert 80 is prevented from being separated from the tray T by the protruding portions 38, 40, 38*a*, 40*a* that are adapted to abut the upper edges of side panels 84 and 86, shown in FIG. 6. The outer side walls 12, 16 continue to be pushed inwardly in directions W and W1 until the side wall panels are placed in an erected condition. In this embodiment, the inner and outer side wall panels 16, 26; 12, 26*a* of the tray T are in a substantially perpendicular arrangement with respect to the base panel 14, as shown in FIG. 7.

Figure 9:
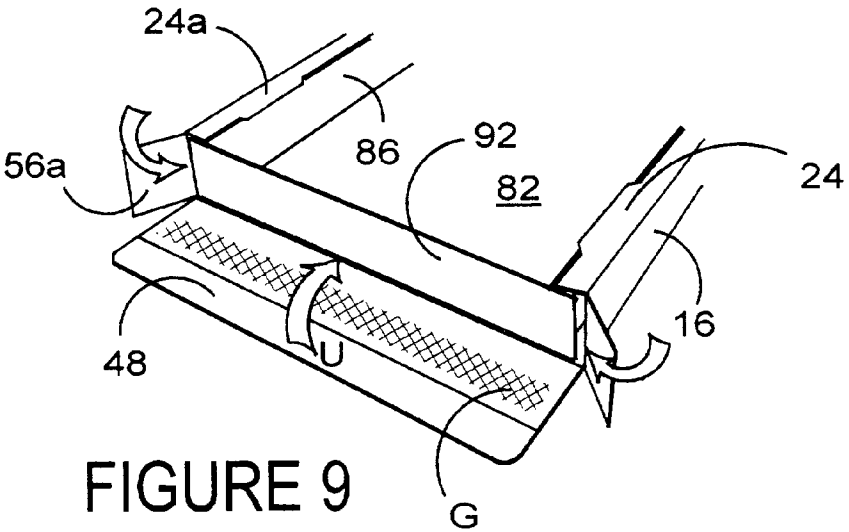
FIGS. 8, 9 and 10 illustrate the construction of the end structures.
Figure 8:
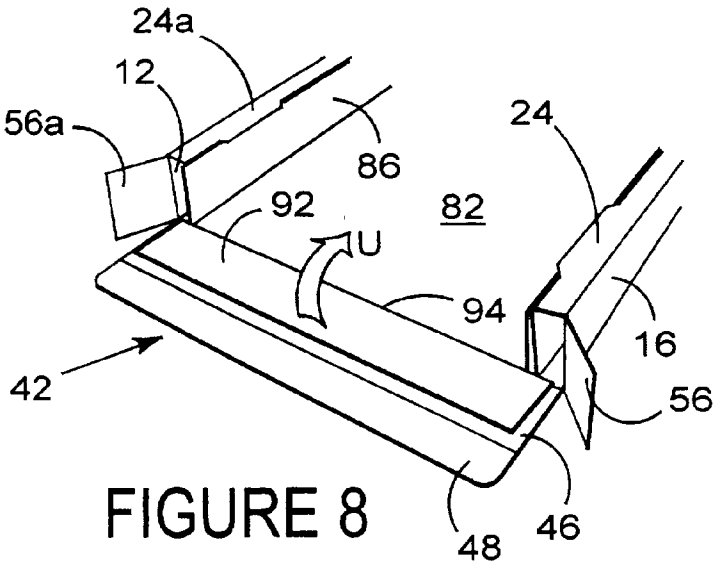

The ends of the tray T is constructed and described with reference to FIGS. 8, 9 and 10. Each end wall structure is constructed in like manner and therefore only one end will be described in any detail. In the illustrated embodiment, end wall panel 92 is first folded inwardly in direction U along fold line 94 thereafter end support flaps 56 and 56*a* are folded inwardly as shown in FIG. 9 and end wall panel 46 is secured to the end flaps 56, 56*a* and, optionally, to the inner end wall panel 92 by glue or other suitable means known in the art.

Figure 10:
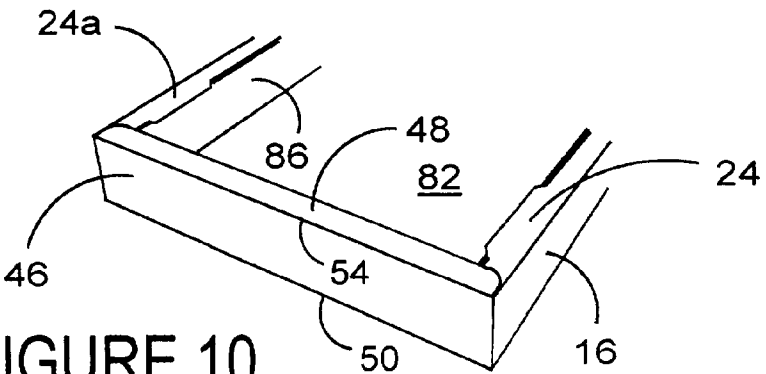

Finally, the end support flap 48 is folded out of alignment with end wall panel 46 along fold line 54 to be placed in overlapping arrangement with spacer panels 24 and 24*a*, as shown in FIG. 10. In those embodiments where the inner end wall panel 92 is not secured to the end wall panel 46 then the end support flap 48 functions in a similar manner to the securing tabs 38, 40 in that the upper edge of inner end wall panel 92 abuts the end support flap 48 to prevent it from being moved in an upward direction.

Thus, the corner structure is disposed internally of the outer panels of the tray to provide a more aesthetically pleasing carrier and to allow promotional material to be viewed with ease.

In other embodiments, the inner and outer end wall panels 92, 46 are folded inwardly together along fold lines 94 and 50 respectively and thereafter the end securing flaps 56 are secured to the outer face of the end wall panels 46 by glue or other suitable means known in the art.

In those embodiments with a fluid retaining structure, the tab 58 is folded out of alignment with respect to the end flap 56 along fold lines 60 and 18, so that as end flap 56 is secured to end wall panel 46, the tab 58 is placed in overlapping relationship with end flap 56 and end wall panel 46 to provide a structure that prevents egress of liquid from the corners. In one class of embodiments the tab forms a deformable portion that extends outwardly of the corner.

The tray T is prevented from moving laterally with respect to the outer tray T because the inner end wall panels 92 and 96 are provided with end portions that extend beyond the inner side walls 16, 12 of the inner tray and to abut the end edges of the side wall panels.

Figure 11:
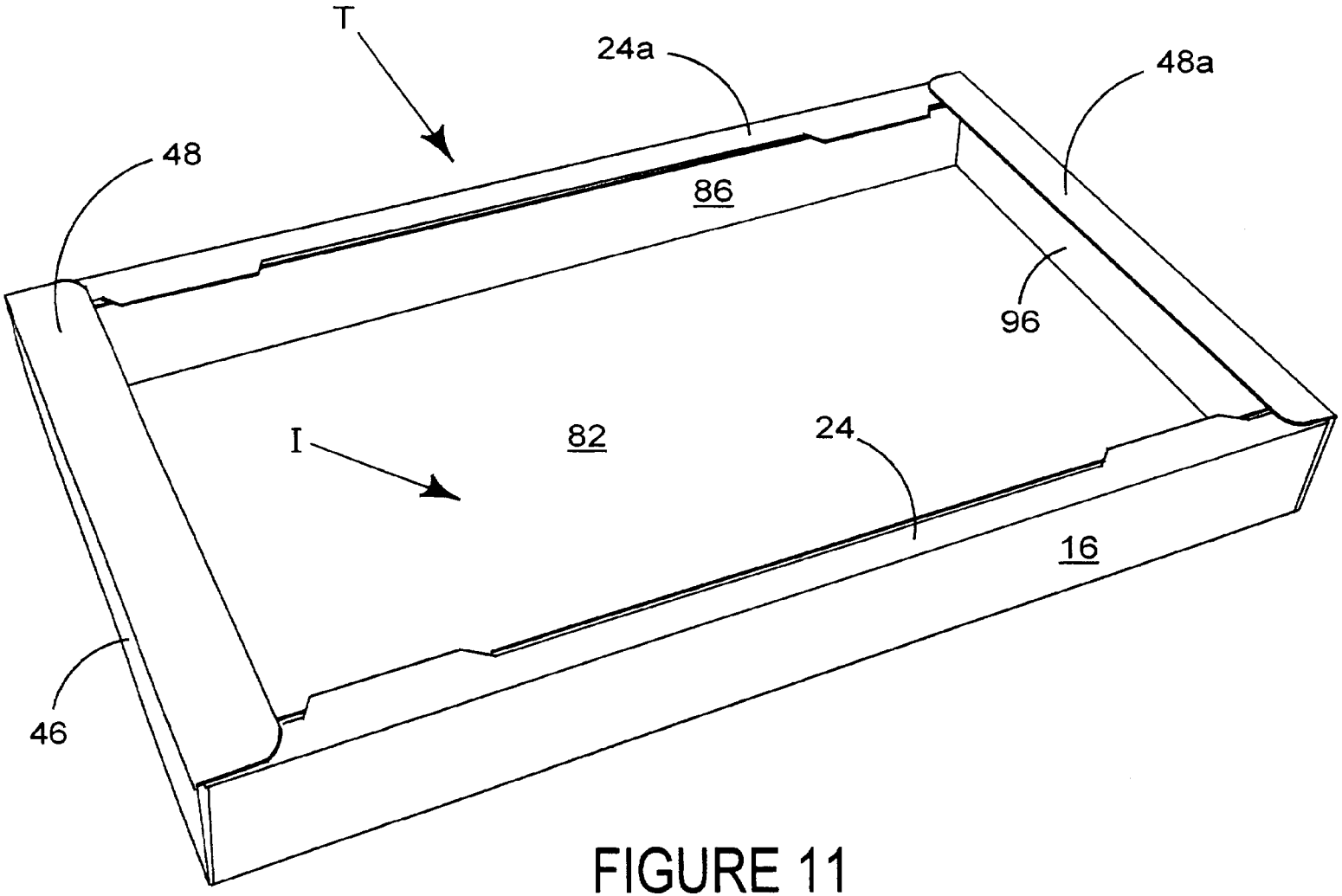
FIG. 11 is a perspective view of a set up tray.

Thus, the tray T is in a set up condition ready to receive an article, as shown in FIG. 11.

Figure 14:
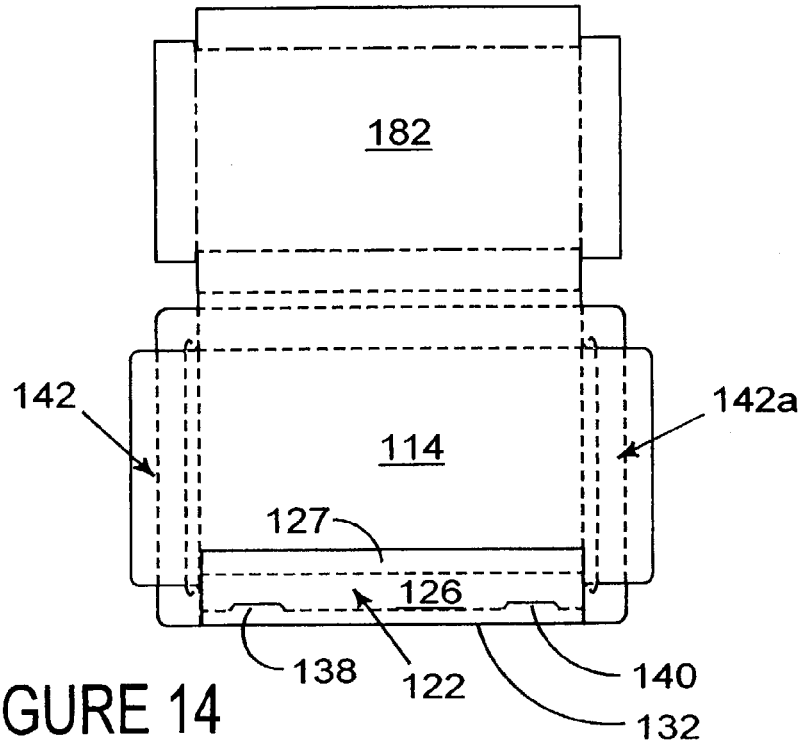

Turning to the construction of the second embodiment shown in FIGS. 13 to 16, the tray is constructed in similar manner as the first embodiment. The first side wall structure of the outer tray is constructed whereby inner side wall panel 126 and space panel 124 are folded inwardly in direction X' along fold line 132 so that securing flap 127 is secured to base panel 114 by glue or other suitable means known in the art. Thus the carton is at an intermediate stage of construction as shown in FIG. 14. Thereafter the insert structure I is folded inwardly along fold line 132*a* into face contacting arrangement with the corresponding panels forming the outer tray T.

Figure 15:
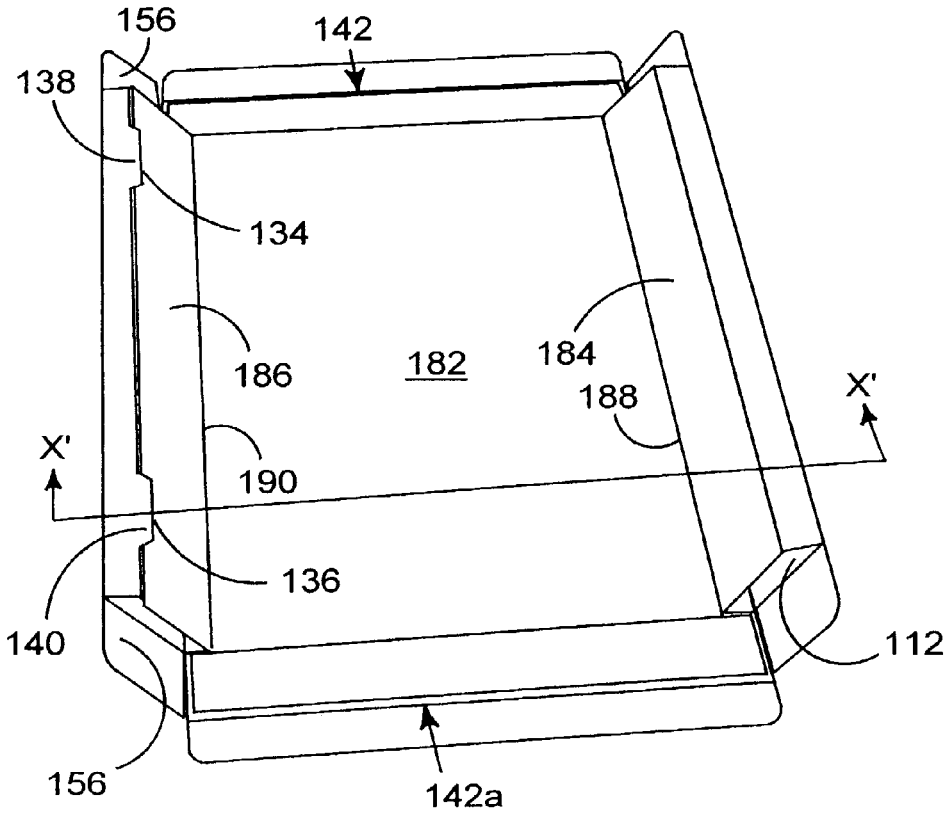
FIG. 15 is a perspective view of the tray shown during folding of the side walls.
Figure 16:
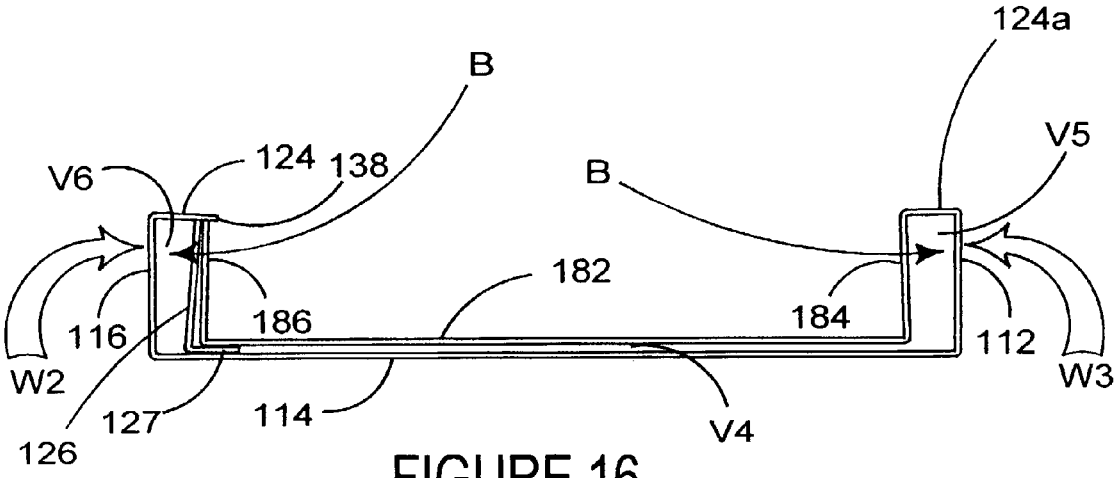
FIG. 16 is a cross sectional view x'—x' of the tray shown in FIG. 16.

In order to construct the tray, the side wall panels are folded inwardly as shown in FIG. 15 whereby protruding tabs 138 and 140 are folded out of alignment with respect to inner side wall panel 126 so that the upper edge of side wall panel 186 abuts the protruding tabs 138, 140. In the second embodiment, as the insert is foldably connected to the outer tray, the second set of tabs along the opposing side wall are not required. The side walls are folded inwardly in direction W2 and W3 along fold lines 120, 130, 120*a* and 130*a* so as to set up the beam B as shown in FIG. 16. The end wall structures are formed, in like manner to that described above and the tray is in a completed and set up condition similar to the tray shown in FIG. 11 ready to receive one or more articles.

One or more articles are placed on the inner tray and the structure is placed over the article and tray to retain the article within the tray, as is well known.

It is envisaged that the support structure can be erected automatically by employing configurations other than those described above, without departing from the scope of invention. For example, the or each support structure could be provided by the end panels.

Thus, a tray T for holding foodstuff or the like is provided which tray is formed from paperboard or like foldable sheet material and can be erected from a flat collapsed condition into a position of use and includes a double skinned zone around the side and end walls and the base wall to provide a void V1, V2, V3, shown in FIGS. 7 and 11 or V4, V5 and V6 in FIG. 16.

In use, excess liquid (or exudate) from the foodstuff is retained in the tray because the base is impermeable. Preferably, the panels providing an internal surface, for example the inner base 82, side and end walls 84, 86; 90, 92 are coated with an impermeable layer.

In the embodiment described above the impermeable layer is a co-polymer for example carboxylated styrene or butadiene.

When the tray is stacked in an upright position, for example on a supermarket shelf, excess liquid tends to collect at the edges and in the corners. In order to remove excess fluid from the tray, a void V1 is provided by the double skinned zone, shown in more detail in FIG. 7. The resulting void V2 and V3 is between the side (and end) panels 12, 16 and the support panels 32, 34 and 40, 42 which can be used to receive surplus food liquid (e.g. blood or water) present in the tray by means to give fluid communication between the internal surface of the base and the void.

It is envisaged that the or each void V1, V2, V3, V4, V5 or V6 could be adapted to receive suitable absorbing material, for example absorbing stamp or bag, preferably during the initial set up process or by the application of absorbing polymer gel, for example polyacrylamide, during the set up or gluing steps of carton construction. More preferably, liquid can be absorbed directly by the inner surfaces 49 of the panels providing the double skinned zone as shown in FIG. 7. In one class of embodiments the effect of capillarity encourages movement of the liquid away from fluid communication means in the void.

Preferably, the means to give fluid communication is provided by a plurality of cuts or perforations 19 struck from the inner base panel 82 to assist in movement of liquid from the upper surface of the inner base panel 22 into the or each void V1, V2, V3. In those embodiments where fold lines 88, 90, 189, 190 are defined in part by a series of cuts 19, 119 the cuts can assist in fluid movement.

Beneficially, the two ply embodiment hereinbefore described provides a structure that is strengthened to retain foodstuff. The use of paperboard material provides an "environmentally friendly" alternative to trays formed from plastics material and the tray can include printed matter for marketing purposes, as the board can be recycled. The arrangement of the panels for the tray in the embodiment described above allows printed matter to be placed on the internal and external side and end walls of the tray.

A further advantage of the arrangement described above is that the material used for the tray and insert can differ. For example a different caliper of paper can be used, or the insert could be a food grade material, whilst the outer tray could be a material that is more suited to the application of printed matter.

It will be recognised that as used herein, directional references such as "top", "base", "end", "side", "inner", "outer", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

The present invention and its preferred embodiment relates to a tray which is shaped to provide satisfactory rigidity to hold items such as meat or fish securely but with a degree of flexibility. The shape of the blank minimises the amount of paperboard required for the carton. The items can be applied to the carrier by hand or automatic machinery. It is anticipated the invention can be applied to a variety of carton or tray types and not limited to those of the flat tubular sort, for example the flat tubular structure could be replaced by a structure with longer sides and end panels to receive larger cuts of meat. Furthermore, the double skinned zones can be formed on the inner panels of the carton, without departing from the scope of invention.

What is claimed is:

1. A tray formed from at least one blank of foldable sheet material, the tray comprising a pair of inner and outer tray members, the inner tray member comprising a base panel and a side panel, the outer tray member comprising a base panel, a pair of inner and outer spaced side panels and a spacer panel interconnecting upper edges of the inner and outer side panels, the inner side panel being disposed alongside an outside surface of the side panel of the inner tray member, wherein the outer tray member comprises a securing tab to retain the inner tray member within the outer tray member, the securing tab being cut out from the inner side panel of the outer tray member and extending inwardly from the spacer panel to be engaged with a free upper edge of the side panel of the inner tray member.

2. The tray as claimed in claim 1 wherein said at least one blank comprises two separate blanks, the inner tray member is provided by an insert formed from one of the two blanks, and the outer tray member is formed from the other blank.

3. The tray as claimed in claim 1 wherein the inner and outer tray members are of a one-piece construction and hingedly connected to each other.

4. The tray according to claim 1 wherein the spacer panel and the inner and outer side panels in cooperation form a beam structure, the inner side panel is hingedly connected along a first fold line to the base panel of the outer tray member and the outer side panel is hingedly connected along a second fold line to said base panel of the outer tray member, and wherein the first and second fold lines are offset from each other.

5. The tray as claimed in claim 1 wherein the inner tray member further comprises an end panel, the outer tray member further comprises an end panel disposed alongside an outside surface of the end panel of the inner tray member, the end panel of the inner tray member extends outwardly beyond the base panel of the inner tray member to be sandwiched between an end of the inner side panel and the end panel of the outer tray member to restrict movement of the inner tray member within the outer tray member.

6. A tray formed from at least one blank of foldable sheet material, the tray comprising a pair of inner and outer tray members, the inner tray member comprising a base panel and an substantially rectangular end panel, the base panel having opposed end edges and opposed side edges, the end panel being hingedly connected to one of the end edges of the base panel, the outer tray member comprising a base panel, a side panel and an end panel disposed alongside an outside surface of the end panel of the inner tray member, the end panel of the inner tray member extends outwardly beyond one of the side edges of the base panel of the inner tray member in the blank to be sandwiched between an end of the side panel of the outer tray member and the end panel of the outer tray member to restrict movement of the inner tray member.

7. The tray as claimed in claim 6 wherein said outer tray member further comprises a deformable portion hingedly connected to the side and end panels of the outer tray member, said deformable portions being disposed to provide a ply of material spanning a gap between the end and side panels of the outer tray member to inhibit egress of fluid from the tray.

8. The tray as claimed in claim 7 wherein the outer tray member further comprises an end securing flap hingedly connected to the side panel of the outer tray member along a first fold line and secured to the end panel of the outer tray member, and the end securing flap is hingedly connected to the deformable portion by a second fold line that is disposed in annular relationship with the first fold line.

9. The tray as claimed in claim 8 wherein the second fold line is disposed in an angular relationship with a third fold line interconnecting the end and base panels of the outer tray member.

10. The tray as claimed in claim 7 wherein the inner and outer tray members define one or more skinned zones providing one or more voids, wherein the inner tray member comprises means for providing fluid communication between an internal surface of the inner tray member and said one or more voids so that fluid present in the tray can drain into the one or more voids.

11. The tray according to claim 10 wherein said means for providing fluid communication comprises a plurality of perforations distributed along at least one edge of the base panel of the inner tray member.

12. The tray according to claim 10 wherein the one or more voids include absorbing means to absorb said liquid.

13. The tray according to claim 12 wherein the absorbing means is provided by a layer of liquid absorbing material placed in the one or more voids.

14. The tray according to claim 10 wherein the internal surface of the base panel of the inner tray member is impermeable.

15. A blank for forming a tray comprising a plurality of panels for forming a pair of inner and outer tray members, the inner tray member comprising a base panel and a pair of side panels hingedly connected to the base panel, the outer tray member comprising a base panel, an outer side panel hingedly connected to the base panel of the outer tray member, a spacer panel hingedly connected to the outer side panel, and an inner side panel hingedly connected to the spacer panel, wherein the outer tray member comprises a securing tab for retaining the inner tray member within the outer tray member when the tray is erected from the blank, the securing tab being formed from the inner side panel of the outer tray member and extending from the spacer panel into the inner side panel so that the securing tab moves out of the plane of the inner side panel and is engaged with a free edge of one of the side panels of the inner tray member when the tray is erected.

16. The blank as claimed in claim 15 wherein the inner and outer tray members are of a one-piece construction and hingedly connected to each other.

17. The blank according to claim 15 wherein the inner side panel is hingedly connected along a first fold line to the spacer panel, the spacer panel is hingedly connected to the outer side panel along a second fold line, and the outer side panel is hingedly connected along a third fold line to said base panel of the outer tray member, wherein the first, second and third fold lines are offset from one another.

18. The blank according to claim 17 wherein the spacer panel and the inner and outer side panels are arranged to form a beam structure when the tray is erected.

19. A unitary blank for forming a tray comprising a plurality of panels for forming a pair of inner and outer tray members, the inner tray member comprising a base panel and an substantially rectangular end panel, the base panel having opposed side edges and opposed end edges, the end panel being hingedly connected to one of the end edges of the base panel, the outer tray member comprising a base panel, an outer side panel hingedly connected to the base panel of the outer tray member, a spacer panel hingedly connected to the outer side panel, an inner side panel hingedly connected to the spacer panel, and an end panel hingedly connected to the base panel of the outer tray member, the end panel of the inner tray member extends outwardly beyond one of the side edges of the base panel of the inner tray member so that the end panel of the inner tray member is sandwiched between an end of the inner side panel of the outer tray member and the end panel of the outer tray member when the tray is erected.

* * * * *